US008342976B2

(12) United States Patent
Crawford et al.

(10) Patent No.: US 8,342,976 B2
(45) Date of Patent: Jan. 1, 2013

(54) GRAVITY SLIDE RIDE SYSTEM

(75) Inventors: David W. Crawford, Long Beach, CA (US); Edward A. Nemeth, Hermosa Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 324 days.

(21) Appl. No.: 12/899,271

(22) Filed: Oct. 6, 2010

(65) Prior Publication Data

US 2012/0088592 A1 Apr. 12, 2012

(51) Int. Cl.
*A63G 1/28* (2006.01)
*A63G 1/00* (2006.01)

(52) U.S. Cl. ..... 472/47; 472/130

(58) Field of Classification Search ..... 472/29–34, 472/38, 42, 47, 50, 130
See application file for complete search history.

(56) References Cited

U.S. PATENT DOCUMENTS

| | | | | |
|---|---|---|---|---|
| 3,598,403 | A | 8/1971 | Bartlett | |
| 5,658,200 | A | 8/1997 | Nobbs, Jr. | |
| 5,820,469 | A | 10/1998 | Nobbs, Jr. | |
| 6,884,177 | B2 * | 4/2005 | Zambelli et al. | 472/47 |
| 2009/0209357 | A1 | 8/2009 | Crawford et al. | |

FOREIGN PATENT DOCUMENTS

| | | | |
|---|---|---|---|
| CN | 2165900 | Y | 1/2012 |
| DE | 8501355 | U1 | 8/1988 |
| EP | 0187955 | A2 | 7/1986 |
| GB | 152995 | | 9/1921 |
| GB | 248240 | | 7/1925 |
| GB | 405725 | A | 2/1934 |
| GB | 2278291 | A | 11/1994 |

OTHER PUBLICATIONS

European Search Report, EP11178718, dated Jan. 26, 2012, from Munich.

* cited by examiner

*Primary Examiner* — Kien Nguyen
(74) *Attorney, Agent, or Firm* — Marsh Fischmann & Breyfogle LLP; Kent A. Lembke

(57) ABSTRACT

A rotating hub ride configured to position passenger vehicles at different vehicle radii relative to the hub's axis of rotation. The ride includes curved support arms extending outward from the hub, with a first end coupled to the hub at a lower height than a second end of the arm. A vehicle is attached, via a mounting assembly, to each curved support arm to slide radially inward and outward on the arm in response to forces applied to the vehicle due to rotation of the hub, e.g., at two or more hub rotation rates. The arm or track defines a travel path for radial movement of the vehicle. When hub rotation is halted, the vehicle slides inward on the track to a load position corresponding to a minimum vehicle radius. At increasing hub speeds, the vehicle slides outward to position the vehicle in any of a number of vehicle radii.

21 Claims, 9 Drawing Sheets

GRAVITY SLIDE RIDE SYSTEM

BACKGROUND

1. Field of the Description

The present description relates, in general, to amusement park rides and other entertainment rides such as round rides, and, more particularly, to amusement or theme park round rides configured to position vehicles at two or more radii on support arms that are attached to a central hub. The central hub is rotated at two or more speeds so as to provide passengers in the vehicles a dynamically changing ride experience.

2. Relevant Background

Amusement and theme parks are popular worldwide with hundreds of millions of people visiting the parks each year. Park operators continuously seek new designs for rides that attract and continue to entertain park visitors. Many parks include round rides that include vehicles or gondolas mounted on support arms extending outward from a centrally located structure that is rotated by a drive assembly. The passengers or riders sit in the vehicles and are rotated by the drive assembly, which spins the structure about its central axis.

In some of these rides, the passengers may operate an interactive device, such as a joystick in the vehicle, to make the support arm and their attached vehicle gradually move upward or downward within a limited, preset range such as by pivoting the support arm at its connection to the central hub. Some rides also allow the passengers to control the pitch of their vehicle. However, even with these added features, it is difficult to provide a round ride that attracts repeat riders because the ride experience is repetitive and predictable. For example, the support arm typically has a fixed length and the vehicle is rigidly or pivotally mounted at a fixed location on the support arm. Hence, the radius at which the vehicle rotates about the central hub or rotation assembly does not vary much resulting in ride dynamics, such as centripetal force applied to the vehicle and vehicle speed, that are unchanging or vary only within a small range.

There remains a need for new round rides that improve the ride experience such as by providing a larger range of ride dynamics, e.g., bigger range of vehicle speeds, while retaining the benefits of a rotating structure or round ride including a small footprint, simple control systems, and relatively low construction and maintenance costs.

SUMMARY

The present description teaches a new round ride or rotating hub ride that is configured to position passenger vehicles at different vehicle radii relative to the hub's axis of rotation. Briefly, this is achieved by providing curved, arcuate, or otherwise shaped support arms extending outward from the central rotating structure or hub, with a first end that is coupled to the hub being at a lower height or elevation than a second end of the arm. A passenger vehicle is then attached, via a mounting assembly, to each curved support arm so as to be able to slide radially inward and outward on the arm in response to forces applied to the vehicle due to rotation of the hub, i.e., the "centrifugal force." The support arm defines a track for radial movement of the vehicle and may be considered a track member or simply a track. When the hub is not rotated, the vehicle slides on the track to a position corresponding to a minimum elevation or valley. Then, when the hub is rotated at increasing speeds, the vehicle slides further and further outward to position the vehicle at any of a number of vehicle radii between a minimum vehicle radius and a maximum vehicle radius associated with a maximum hub rotation rate (and track/vehicle configuration). Typically, the vertical curvature of the track increases as the track extends further from the central hub such that the forces on the vehicle (gravity versus centrifugal) reach equilibrium at a different position on the track for each rotational speed of the central hub.

The "gravity slide" ride described herein provides a number of advantages over conventional round rides. The radial sliding provides a new ride experience. The ride provides an unusual vehicle motion with minimal rigid attachment to structure and provides for large variation in lateral or radial position. Passengers experience increased speed as their vehicle moves outward along the track. The gravity slide ride is not complex to manufacture, install, maintain, or control and is likely relatively inexpensive to provide as a new park ride. The drive system spins the central structure or hub as well as the tracks that extend radially outward from the hub. However, the motion of the vehicles on the track is passive or non-powered/non-actuated as they simply slide in response to centrifugal forces. Hence, the ride has a single actuator/motor system, and all motion/dynamics come from rotation of the hub and, hence, vehicle motion/dynamics may be varied simply by changing the rotational speeds of the hub. The track geometry or shape may be customized or designed to provide a wide variety of radial/lateral vehicle travel paths, e.g., a track with an axial twist along its length can rotate the vehicle relative to the ground as it moves radially inward and outward on the travel path defined by the track.

More particularly, a ride apparatus or round ride is provided to create a unique gravity slide ride. The ride includes a drive assembly on a foundation or platform that has a drive and a hub or central rotating structure. During operation of the drive, the hub is rotated about an axis of rotation at a first rotation rate and at a second rotation rate greater than the first rotation rate (e.g., at two or more rotation rates and the rates between such rates as the hub is sped up and slowed down). The ride includes a plurality of support arms or tracks that are mounted to the central rotating structure.

Each track extends laterally outward from an end coupled to the hub and defining a travel path with a first position proximate to the hub at a first height relative to the foundation and with a second position distal from the hub at a second height relative to the foundation that is greater than the first height. The ride also includes, on each track, a passenger vehicle and a vehicle-to-track mounting assembly supporting the passenger vehicle on the track. The mounting assembly is configured such that during rotation of the hub the radially outward forces move the passenger vehicle to the first position on the track when the hub is rotated at the first rotation rate and to the second position on the track when the hub is rotated at the second rotation rate.

In one embodiment of the ride, the mounting assembly rollably engages the track such that the passenger vehicle rolls on the track between the first and second positions as the drive increases or decreases the rotation rate of the hub between the first and second rotation rates. For example, a bogie or wheel carrier may engage outer surfaces of the track body or an inner channel of the track body. The mounting assembly may couple or connect with the track to position the passenger vehicle between the track and the foundation (or to position the vehicle above or along one side of the track body). The ride may support interactivity such as by having the passenger vehicle include an input device operable by a passenger of the passenger vehicle to limit a rate of movement of the passenger vehicle between the first and second positions (e.g., a braking system), whereby the input device is operable to define a radial position of the passenger vehicle relative to the axis of rotation.

In some embodiments, the track has an elongate body with a longitudinal axis (such as a long rectangular or circular cross section body). The body may be generally curved, arched, inclined, or otherwise shaped and may include intermediate geometry such as hills, bumps, valleys, or even an axial twist between the first and second positions. In this manner, the passenger vehicle is rotated relative to the foundation during movement along the travel path between the first and second positions (e.g., the axial twist may be at least about 20 degrees up to 90 degrees or more). The track geometry may include variation in the slope of the track such that when the vehicle passes a particular point on the track the vehicle experiences a relatively large outward excursion to the next equilibrium point.

The track generally increases in elevation or height from the first to the second positions of the track in most embodiments with a wide variety of track geometries being useful in the ride. For example, the track may have a curved or arcuate profile between the first and second positions with at least two radii of curvature, whereby the track has a curvature (or slope) that is increasing in magnitude between the first and second positions at two or more rates. Typically, the slope of the track increases as the arm extends outward from the central hub such that the vehicle reaches a first equilibrium point on the support arm (track) at a first hub rotation rate or speed and then reaches a second equilibrium point on the support arm (that is spaced apart from the first equilibrium point) at a second hub rotation rate or speed, which is greater than the first hub rotation speed.

The track can be configured such that the slope always increases as the track extends outward from the hub. In this case, a vehicle simply moves further outward as the speed of the hub is increased in a direct relationship to the rotation speed of the hub. Additionally, the slope can be held constant along some sections or portions of the track (e.g., an inner, first track section at a first smaller slope and an outer, second track section at a second larger slope to support two equilibrium points and hub rotation speeds). In this manner, a vehicle, upon entering each slope-constant section of track, simply drifts outward or inward through that section without any additional change in hub rotation speed. The speed at which the vehicle travels through the constant slope section of the track depends on the slope of the track. A slope near the equilibrium point would produce relatively slow transition or movement of the vehicle while a slope more nearly flat would produce a more rapid transition or movement of the vehicle in the constant slope section of the track.

According to another aspect of the description, a round ride is provided with vertical loading and flying vehicle positions to facilitate passenger loading and providing a flying ride experience. The ride includes a central hub first operated in a stationary position, second operated to rotate about an axis of rotation at a first rotation rate, and third operated to rotate about the axis of rotation at a second rotation rate faster than the first rotation rate. The ride also includes a track member supported on the central hub and extending outward from the axis of rotation of the central hub. The track member has a body with a longitudinal axis and, significantly, has an axial twist between a first position and a second position more distal from the axis of rotation than the first position. The ride also includes a vehicle adapted for supporting a passenger(s). The vehicle is slidably mounted on the track body such that it slides radially inward and outward on the track body in response to rotation of the central hub to be positioned proximate the first position when the central hub is stationary, at an intermediate position between the first and second positions when the central hub is rotated at the first rotation rate, and proximate the second position when the central hub is rotated at the second rotation rate.

In some embodiments of the ride, the axial twist causes the vehicle to rotate from a first angular orientation relative to a plane extending through the axis of rotation when the vehicle is positioned proximate to the first position to a second angular orientation relative to the plane when the vehicle is positioned at the second position. In some cases, the rotation of the vehicle to the second angular orientation is selected from the range of 30 to 90 degrees of rotation. In this manner, the first angular orientation places a vertical plane of the vehicle within 15 degrees of parallel with the plane extending through the axis of rotation, whereby the vehicle is rotated from a substantially vertical loading position associated with the first position on the track to a prone flying position associated with the second position on the track.

DETAILED DESCRIPTION

Figure 1:
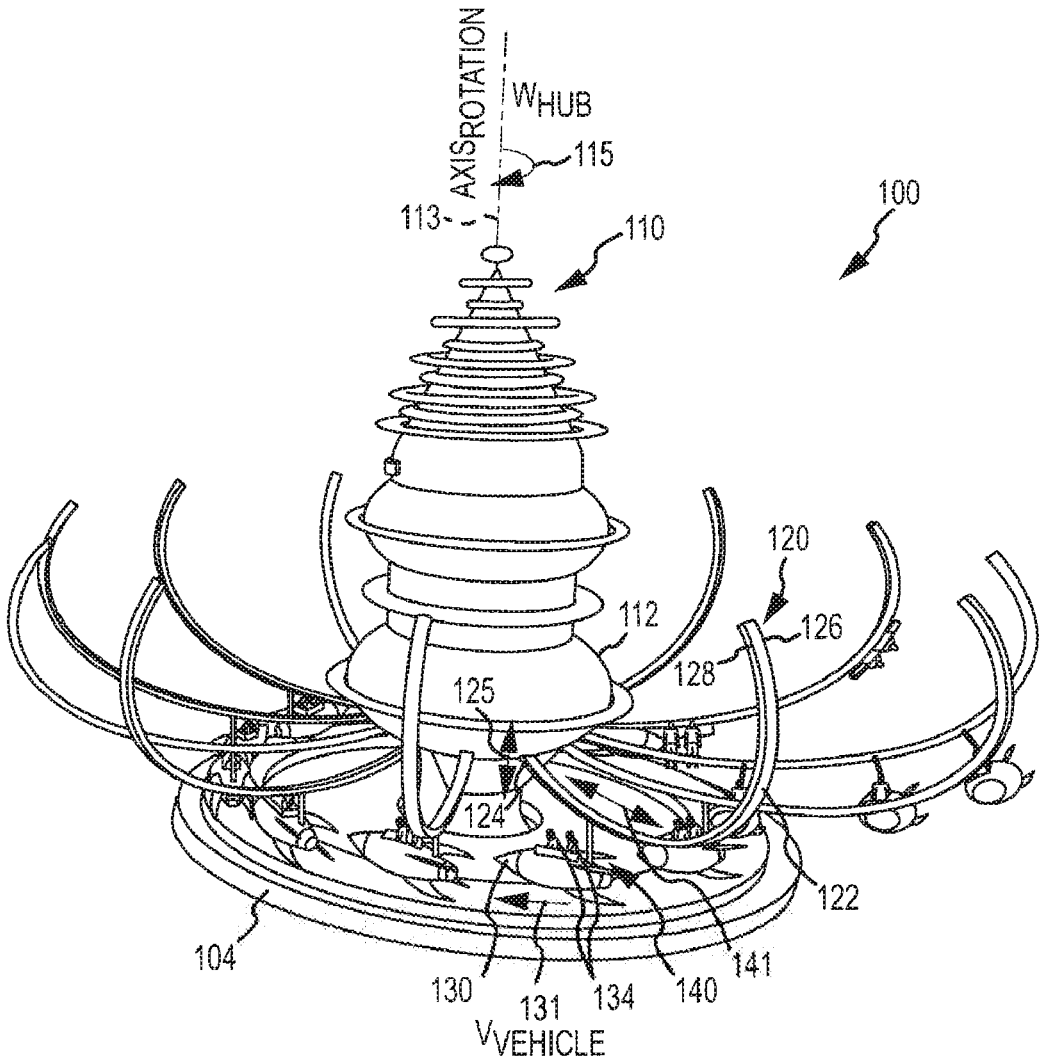
FIG. 1 is a perspective side view of gravity slide ride system (slide ride or the like) according to one embodiment showing vehicles positioned below a track (or slide-providing support arm or boom defining a lateral or radial travel path extending outward from the rotatable hub) and mounted for sliding (freely or with some throttling/braking) within a range of differing radial positions along the track in response to differing hub rotation rates and slopes (vertical curvature) of the track.

The description is generally directed to an amusement park ride that provides a fun and exciting ride experience utilizing a simple rotating structure (e.g., a rotating central hub). A gravity-based slide ride system is provided with a central rotatable structure or hub and multiple tracks or support arms that include track elements with two or more slopes of increasing magnitude as the outer end or tip of the track element is approached. The tracks are attached at a first end to the hub via a rigid coupling or via a connection that may be pivoted by a ride control system based on a ride program or in response to input from a passenger in a vehicle (e.g., operate a joystick to cause the track to pivot up or down). The tracks extend radially outward from the hub to a second end. A passenger-carrying vehicle is attached to each track with a vehicle-to-track mounting assembly. Significantly, the mounting assembly is configured such that the vehicle is attached to the track in a manner that allows the vehicle to freely move or slide along the track in either radial direction between the first and second ends of the track (or slide freely except when with throttling/braking controlled by the ride control system or a passenger input device on the vehicle).

In other words, the vehicle on each track or arm may have an initial load radius that is relatively small such that the vehicle is near the hub. Then, during rotation of the hub, the vehicle slides further and further outward with increasing rotation rates of the hub such that each vehicle will have multiple positions on the track during operation of the ride (e.g., any of a large number of vehicle radii between a initial/minimum/load radius and a maximum radius associated with a maximum or top rotation rate for the particular ride, with the radii being measured from an axis of rotation for the hub). The ride system may be designed to tune the amount of radial sliding that occurs by controlling the hub rotation rates and with the shape or profile of each track or support arm defining two, three, or more slopes in sections of the arm (e.g., establishing differing equilibrium points for the vehicle for each hub rotation rate that places the vehicle in two, three, or more radial locations relative to the hub's rotation axis).

The shape of the tracks used in the slide ride system may take a wide variety of forms to practice the ride system. For example, the track may, in some cases, be generally linear (e.g., two or three linear sections setting up two, three, or more constant slope sections) while some preferred embodiments utilize a curved or bowed track (i.e., from the load radius to the maximum radius position on the track the track or arm may have a concave curved surface relative to the hub) to provide a generally increasing slope in the track resisting further outward movement of the vehicle. The track may additionally incorporate track elements such as humps, bumps, dips, drops, or twists that deliver interesting vehicle dynamics as the vehicle moves back and forth over these track elements. Regardless of the particular shape/profile of the track, the track, during operation of the ride, is supported relative to the hub such that the track at the load radius position has a minimal slope of the track than at the maximum radius position (which corresponds to a higher slope that requires a higher rotation rate to move the vehicle outward to this point on the track). In other words, a curved track would be described as curving upwards as it extends away from the central structure or hub, with the first end of the track that is attached to the hub being lower than the second end of the track so as to provide a generally increasing slope.

With this arm/track design, a unique equilibrium or vehicle riding point exists for the passenger vehicle for each rotational speed of the hub. The equilibrium point depends on the speed of rotation and shape of the track and is substantially independent of the vehicle weight. The track may be fixed to the hub at its first/mounting end or be attached through an actuated joint such that the vertical angle of the track (and height of the second end) may be changed during the course of the ride either by the ride control system or in response to a passenger input. During ride system operation, the hub is rotated and centrifugal forces act radially outward on the vehicle to push it outwards along the track to an equilibrium point on the track for the hub's present rotation rate and the slope of the track in which the vehicle is traveling. The faster the rotation of the hub, the further outward the vehicle equilibrium point will be on the track (i.e., the greater the vehicle radius relative to the axis of rotation extending through the hub).

In this way, reactive centrifugal forces created by the spinning center structure impart an outward radial force to the sliding vehicle, which overcomes the gravitational force and moves the vehicle up the track towards the next or second position. When the rotational rate of the spinning structure decreases, gravity will force the vehicle back down to the first (or prior) track position. In this manner, vehicle position is constantly dependent on the balance between gravity and reactive centrifugal forces.

The ride control system runs a ride program that defines two, three, or more hub rotation rates that cause the vehicle to move/slide to two, three, or more vehicle radii (or vehicle riding positions along the length of the track). When the hub is stopped, the vehicles all return under gravity to a valley or lowest slope portion in the track or to the load/unload position corresponding to the minimum or initial vehicle radius.

FIG. 1 illustrates an exemplary gravity slide ride system 100 that may be used to position a passenger vehicle at differing radii so as to create differing ride dynamics (e.g., lateral movement, varying sightlines, changing vehicle velocities, and so on). The ride 100 includes a platform or foundation 104 upon which is mounted and supported a drive and support assembly 110. The assembly 110 includes a hub or central rotating structure 112, and the assembly 110 is adapted with a drive(s) and other components to rotate the hub 112 about its central axis or axis of rotation 113 at two or more rotation rates, $\omega_{Hub}$, as shown with arrow 115 (in one of two directions, but with some embodiments rotating in one direction such as clockwise (as shown) or counterclockwise).

In one non-limiting example, the drive and support assembly 110 is configured as for a typical round iron ride. Specifically, the assembly 110 may take the form of one of the drive and support assemblies designed and distributed by Zamperla Inc., 49 Fanny Road, Parsippany, N.J., USA or assemblies provided by other similar ride design and production companies. Often, such an assembly 110 operates at relatively low speeds such as less than about 20 revolutions per minute (RPM) and more typically less than about 10 RPM such as about 6 RPM in some cases. In one embodiment, the hub 112 is rotated 115 at rates that vary from about 6 RPM, which places or slides the vehicles away from the minimum vehicle radius (or load/unload position) to an intermediate position/radius along the tracks, to a maximum rotation rate in the range of 10 to 20 RPM (or higher), which slides the vehicles further away from the rotation axis to or toward a maximum vehicle radius (and corresponding higher vehicle velocity).

The ride 100 further includes a plurality of tracks (or support arms configured to define vehicle tracks) 120. Each track 120 extends radially outward from the hub 112 and is mounted such that the tracks 120 rotate with the hub 112 about the rotation axis 113. Each track 120 includes an elongated body 122 extending from a first or inner end 124 connected to the hub 112 to a second or outer end 126 spaced apart from the hub 112. As explained in detail below, the second end 126 is typically higher than the first end 124 to control radial travel of a passenger vehicle 130 on the track body 122 by defining a track with two or more slopes (with increasing slope magnitudes with increasing distance from the hub axis 113 or as the end 126 is approached). The height of the second end 126 may be adjusted by pivoting 125 the track body 122 at the connection of first/inner end 124 to the hub 112 such as with a ride control system acting according to a ride program or in response to input from a passenger 134 operating an input device in vehicle 130 to operate an actuator to change the vertical angle of the body 122. Such change in height of the end 126 may increase or decrease the slope(s) of the track 120 so as to alter equilibrium points on the track 120 for each hub rotation rate 115.

The track body 122 defines a travel path for the passenger vehicle 130, and, in the embodiment of FIG. 1, the body 122 includes a groove or slot 128 extending along its length (or a vehicle travel portion) on one side or wall. In ride 100, a passenger vehicle 130 adapted for seating or supporting one or more passengers 134 is mounted to the track 120 with a vehicle-to-track mounting assembly 140 such that the vehicle 130 hangs below the track body 122. More specifically (as will be described with reference to FIG. 3), the mounting assembly 140 mates with a channel within the body 122 via the slot/groove 128 such that the mounting assembly 140 and supported vehicle 130 are free (or relatively free) to slide, roll, or otherwise move 141 along the track in response to rotation 115 of the hub 112.

The vehicle 130 rotates at a range of radii (corresponding to equilibrium points of the vehicle 130) about the axis of rotation 113 due to such radial movement 141 along the track body 122, and the vehicle's velocity, $V_{Vehicle}$, varies with the changes in vehicle radii as well as hub rotation rate, $\omega_{Hub}$. For example, at a particular hub rotation rate, $\omega_{Hub}$, the vehicle/arm combination may have a particular vehicle riding point or equilibrium point along the track body 122 at which point the vehicle radius along with the hub rotation rate, $\omega_{Hub}$, defines a vehicle velocity, $V_{Vehicle}$. However, if the passenger 134 applies a brake to hinder sliding 141, the vehicle 130 may be held at a radius that is larger or smaller than the vehicle radius at such an equilibrium location such that the vehicle velocity, $V_{vehicle}$, would also be larger or smaller than expected at the equilibrium location.

As shown, the ride 100 is configured such that during rotation 115 of the hub 112 about axis 113 vehicles 130 move or "slide" along fixed (or pivoted 125) track arms 120 that extend from a rotating center structure or hub 112. As the hub 112 rotates 115, centrifugal forces act radially outward from hub 112 on the vehicle 130 and push it towards the outer end 126 of the track body 122, with the mounting assembly 140 (in this embodiment) traveling in slot 128 of body 122. As rotation 115 slows or ends, the vehicle 130 returns 141 to a "valley" or lower elevation portion of the track 120 that may correspond to a load/unload position of the ride 100 and corresponds to the smallest or least steep slope portion or section of the track 120. In other words, no radially outward forces are applied on the vehicle 130 when the rotation, $\omega_{Hub}$, is zero, and the vehicle 130 slides under the force of gravity to a portion of track body 122 with a minimum slope (which is typically a portion of the track 120 that is more proximate to, but spaced apart from, the hub 112).

Generally, the track 120 is curved or arched such that it is configured such that track's slope increases with increased radial distance from the hub axis 113. In operation, two or more equilibrium points and corresponding radial vehicle positions exist for the track 120. Equilibrium depends on the slope (or track angle relative to the ground), the rotational speed, $\omega_{Hub}$, and the radial distance from the rotation axis, and an equilibrium point is achieved for a particular speed, $\omega_{Hub}$, when the gravity vector along the track 120 is cancelled by the centrifugal effect for the section of track sloped at a particular angle. As the hub rotation speed, $\omega_{Hub}$, is then increased the net force is again outward causing the vehicle 130 to slide further outward until it reaches a new equilibrium point where the gravity vector along the track 120 is cancelled by the centrifugal effect for the section of track (which is sloped to a greater degree or at a larger angle). In contrast, when the rotation rate, $\omega_{Hub}$, is decreased, the centrifugal force is reduced such that gravity causes the vehicle 130 to slide inward to a section of track 120 that is sloped to a lesser degree or at a smaller angle.

The track 120 and the travel path it defines may be customized to create the desired vehicle velocities, vehicle radii, and vehicle orientations during operation of the ride 100. The track body 122 may have a rectangular cross section and arc upward from end 124 to end 126 as shown (to define numerous track sections with increasing slope or greater track angles relative to ground that define numerous equilibrium points for like numbers of hub rotation rates, $\omega_{Hub}$) or may take many other useful forms. Similarly, when curved as shown, the radius of curvature may also be varied widely to practice the invention and may vary along the length of the body 122 from end 124 to end 126 to achieve a desired vehicle movement and desired equilibrium points (radial positions of vehicle 130 relative to hub axis 113). In preferred cases, though, the travel path defined is between an inner point or location and an outer point or location on the track 120 where the outer point or location of the track 120 is at a greater slope (and elevation) such that the vehicle may simply slide down under gravity to the inner, lower point of the track 120 (which corresponds to a section of track at a more gradual or degree of slope).

However, the elevation gain per linear dimension (or slope) of the track body 122 may vary to cause a vehicle to move outward at differing rates. For example, ride dynamics may be varied by providing a section of the body 122 with a gain in elevation of only 1 foot/10 feet of track so as to allow the vehicle to rapidly travel outward in this section of track (and slowly back inward when rotation slows) and providing an outer portion with a gain of 5 or more feet/10 feet of track so as to slow outer movement (but provide more rapid inward movement upon slowing). Hence, the radius of curvature of the track body 122 does not need to be constant and often will be smaller at the outer portions near end 126 as shown in FIG. 1 so as to more quickly increase slope of the track in these outer portions (e.g., require higher and higher rotation rates, $\omega_{Hub}$, to achieve smaller increases in radial position). Likewise, the support structure 112 may house or support a plurality of arm actuators or base angle mechanisms (not shown) for pivoting 125 the inner or first ends 124 of the track bodies 122. In this manner, the amount of elevation gain (or slope magnitudes) along the length of each track 120 may be varied during rotation 115 of hub 112 to modify the dynamics experienced by each vehicle 130 (e.g., in response to input from a passenger 134 to raise or lower their track 120 to modify the position of their vehicle 130 and/or its velocity, $V_{vehicle}$).

Although not shown in FIG. 1, the ride 100 may be adapted to provide a tilted version with the hub 112 being supported on base 104 in a manner to allow it to be selectively tilted. Specifically, the axis of rotation 113 is shown in FIG. 1 to be orthogonal relative to the ground and base 104. In operation, though, the hub 112 may be tilted to one, two, or more positions such that the rotation axis 113 is not orthogonal such as to an angle of 10 degrees as measured from a vertical axis (e.g., 10 degrees in one direction from the position shown in FIG. 1) while in others a greater tilt angle such as up to about 45 degrees or more may be useful in the ride 100. By tilting the hub 112, the attached arms 120 are also moved such that the slopes of the arms 120 change with each rotation of the hub 112 (greater in the raised portions and lower in the lowered portions of the ride).

Hence, in this tilted version or operating state of ride 100, the vehicles 130 would have radial movement or motion even at a fixed rotation rate, $\omega_{Hub}$, because the slope of the track 120 changes within each rotation 115 of the hub 112. This causes the vehicle equilibrium point to change, too, based on the tilt angle of the hub 112 and a corresponding supporting track 120 (e.g., slope angle had been 30 degrees for a particular section of track 120 for a complete rotation but with a tilting of 10 degrees it now ranges from 20 to 40 degrees for this single section of track causing the equilibrium point where gravitational and centrifugal forces are balanced to also move or be set at a range of radial distances from hub axis 113).

Figure 2:
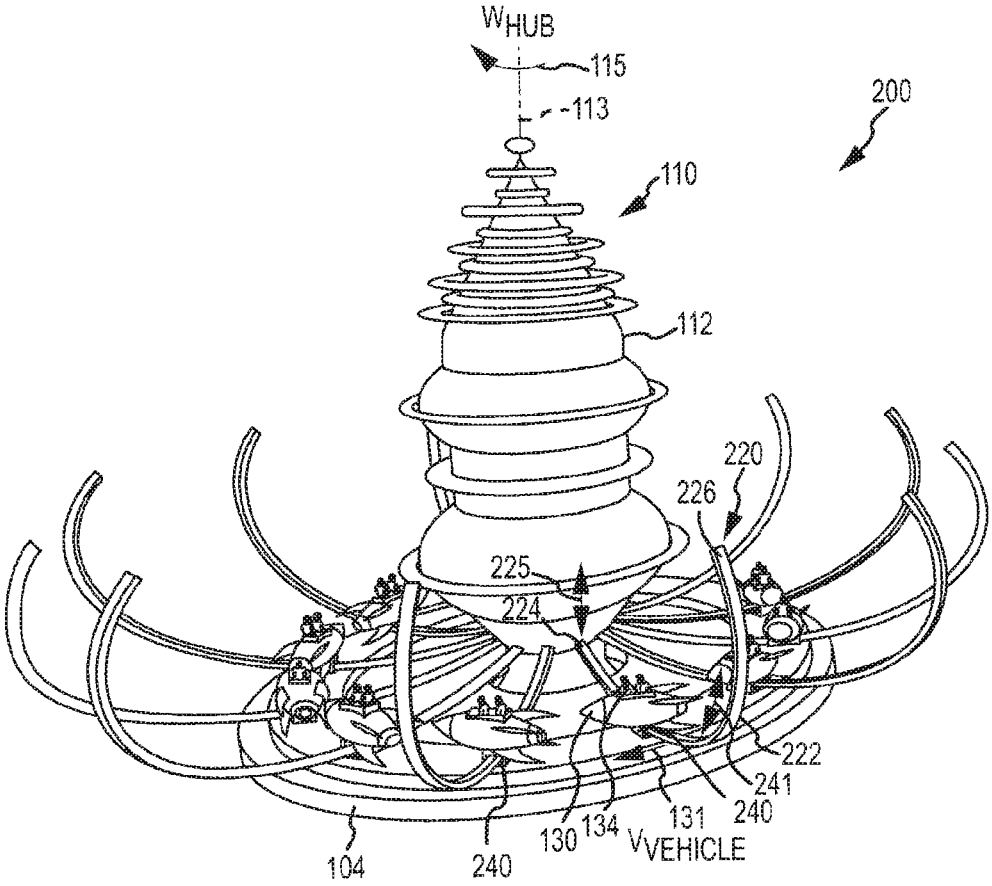
FIG. 2 is a perspective view similar to FIG. 1 of another slide ride embodiment of the present description showing vehicles positioned above a track with a vehicle-to-track connector encasing and sliding upon the track (rather than within a channel or path provided within the track body as in the system of FIG. 1)

The vehicles 130 may be mounted with the assembly 140 underneath the track 120 as shown in FIG. 1. However, this is not a limitation of the invention as the vehicles 130 may be supported upon the track 120 in other ways as long as the vehicle 130 is able to move relatively easily inward and outward on the track 120 during use of the ride 100. For example, FIG. 2 illustrates another ride embodiment 200 with like components having identical numbering as in FIG. 1. In the ride 200, the vehicle 130 is supported upon a track 220 such that the vehicle 130 is above the track 220. The track 220 includes a body 222 with a first end 224 mounted (optionally, for pivoting 225) to the hub 112 and extending radially outward along its length to a second or outer end 226.

The track body 222, in contrast to body 122, does not include an inner channel to define a travel path for the vehicle 130. Instead, the body 122 may define the travel path simply with its outer shape and geometry (e.g., may be a tube or solid bar or shaft rather than having an exposed/open channel). To this end, a vehicle-to-track mounting assembly 240 is provided on an underside of the vehicle 130 such as via rigid or other attachment. The mounting assembly 240 extends about (or receives) the body 222 and may include rollers, wheels, or other devices within it to rollably (or slidably) engage the outer surfaces of the body such that the vehicle 130 may roll upon the track body 222 as radial outward forces are applied to the vehicle 130 during rotation 115 of hub 112 about the axis of rotation 113. In other embodiments, the vehicle 130 may be mounted on the front or back sides of the track for all or a portion of the track length.

Figure 3:
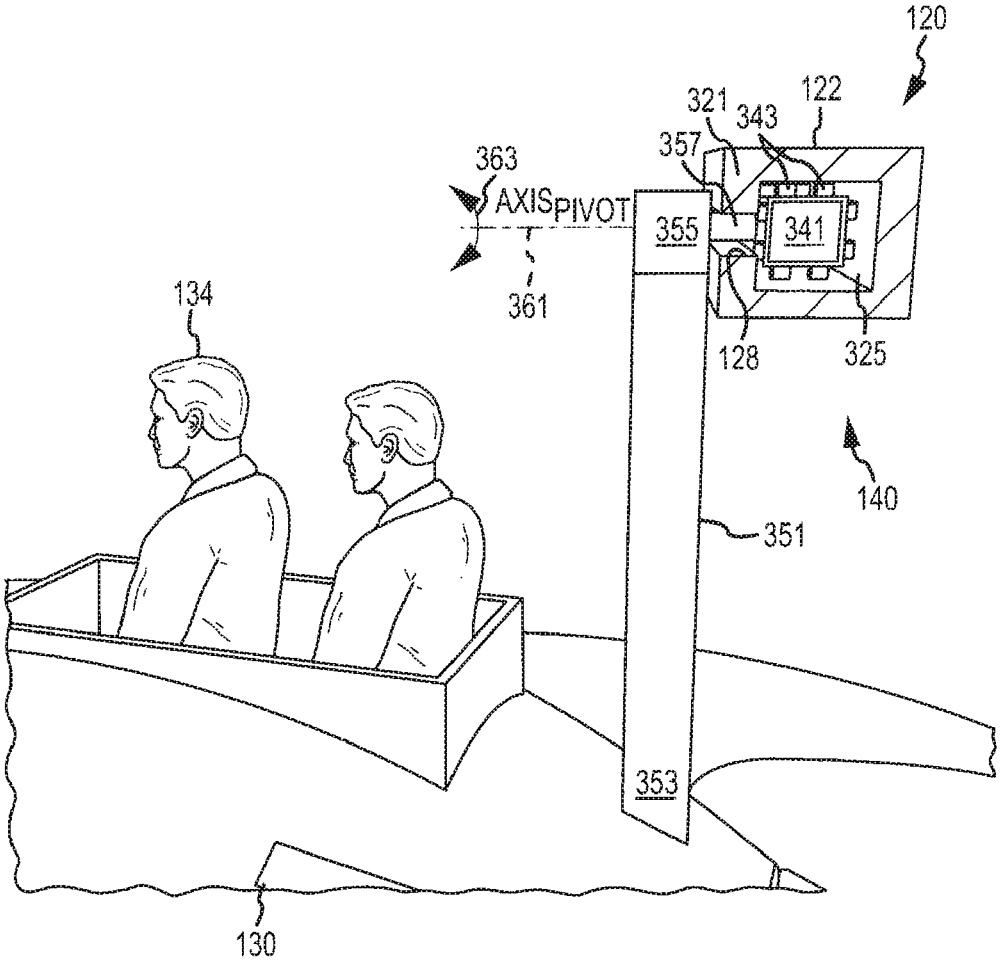
FIG. 3 illustrates partial sectional view of the gravity slide ride system of FIG. 1 showing in more detail an exemplary track and vehicle-to-track mounting assembly that may be used to facilitate radial or lateral inward and outward movement of a vehicle supported upon a track (or on a support arm/boom)

FIG. 3 illustrates in more detail one embodiment of the vehicle-to-track mounting assembly 140 as may be utilized in ride 100 to support the vehicles 130 on the track 120 such that the vehicle 130 may move along its length during rotation of hub 112. Of course, though, as discussed with reference to FIG. 2, the mounting assembly 140 and track 120 shown in FIG. 3 is only one configuration useful for supporting the vehicle 130 upon a track 120, and the invention is not limited to a particular mounting assembly implementation. In the illustrated example, the track 120 includes a channel 325 extending within the body 122 of track 120 at least for the portion of the track defining a travel path for vehicle 130. For example, the channel 325 may terminate at or near the minimum and maximum radial positions of the track body 122 and even provide bumpers/stops to limit or end radial travel of the mounting assembly 140 and attached vehicle 130. The body 122 includes a sidewall 321 that partially defines the channel 325 and that includes the slot or groove 128 extending through its thickness to provide access to the channel 325. Although shown as a front sidewall 321, the wall 321 may be any of the sidewalls of body 122.

The mounting assembly 140 includes a vehicle support arm 351 extending from a first end 353 that is attached to the vehicle 353. This attachment may be rigid or may be pivotal to allow the vehicle 130 to move relative to arm 351. The support arm 351 extends from end 353 to a second end 355 proximate to the track body 122. From the second end 355, a pin 357 extends outward through the groove or slot 128 to mate with a wheel carrier or bogie 341. The bogie 341 is a body used to support (such as upon axles or the like) two or more (often four or more) wheels or rollers 343 that abut the surfaces of the channel 325 of track body 122. In this manner, the support arm 351 is supported upon wheels or rollers that contact the track body 122 so as to rollably engage the track 120 and allow the vehicle 130 to roll along the length of the track body 122 containing the channel 325 and slot 128 (e.g., a stop/bumper could be provided on track 120 at the end of a slot 128 rather than in the channel 325).

The connection between pin 357 and bogie 341 may be pivotal such that the arm 351 and attached vehicle 130 are able to pivot 363 about pivot axis 361 extending though the end 355 and pin 357, e.g., to change the yaw or other vehicle orientation relative to the track 120 as the vehicle 130 moves from one radial position to another via gravitational and centrifugal forces. The pivoting 363 may be free (e.g., simply in response to gravity or other dynamics) or may be a powered/actuated joint, e.g., an actuator may be provided in arm 351 near end 355 to rotate the arm 351 relative to pin 357 and bogie 341.

Based on the discussion of FIGS. 1-3, one skilled in the art will readily understand that there are multiple options for connecting the vehicle 130 to the track arm. The wheel carrier or bogie may run inside the track as shown in FIG. 3, run on top of the track, or "capture" the track arm as discussed with reference to FIG. 2. The particular mounting assembly design chosen for a gravity slide ride may depend on creative and/or performance requirements of the ride, with the only true limitation being that the mounting assembly connects to the track such that the track can be used to define a travel path for the vehicle 130.

Figure 4:
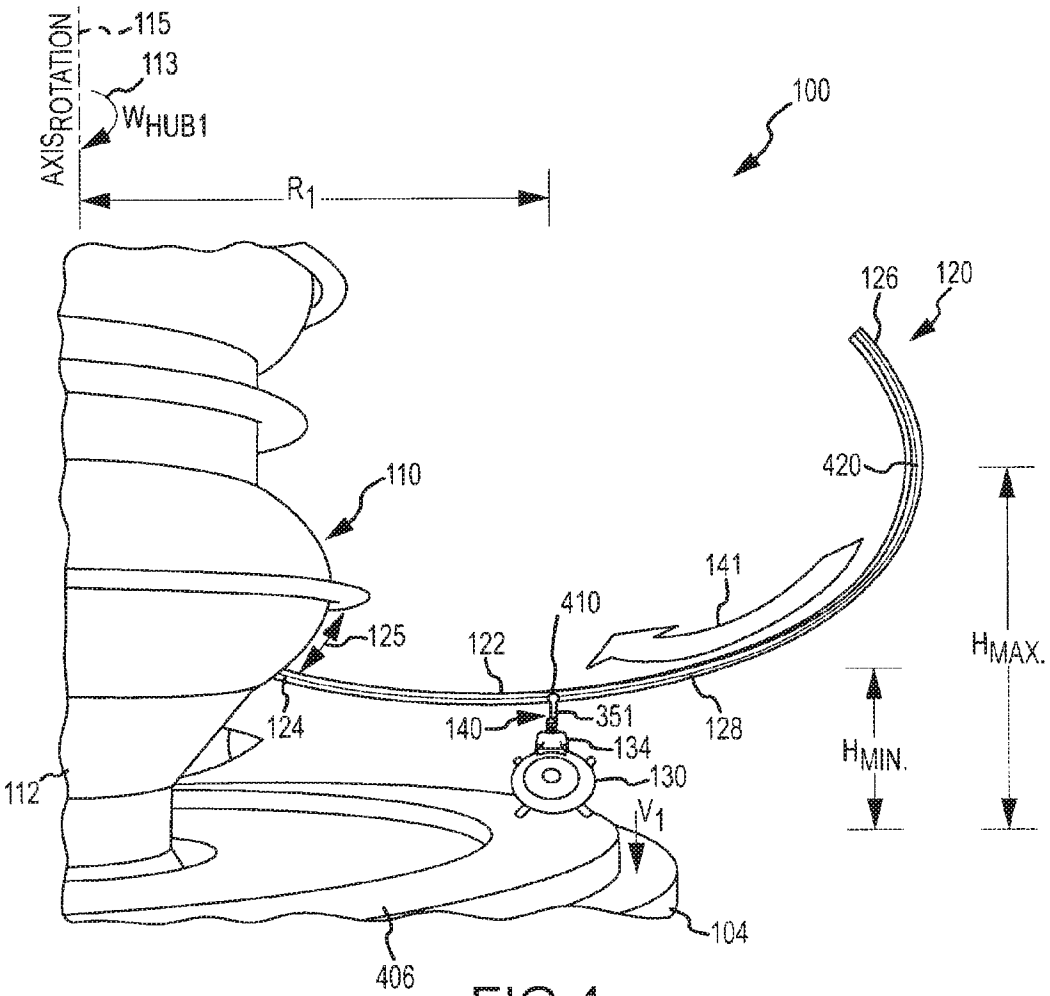
FIGS. 4-6 illustrate partial views of the gravity slide ride system of FIG. 1 in three operational states including, respectively, loading (hub rotation at 0 RPM), at a first hub rotation rate (hub rotation greater than zero), and at a second hub rotation rate (hub rotation rate greater than first hub rotation rate)
Figure 5:
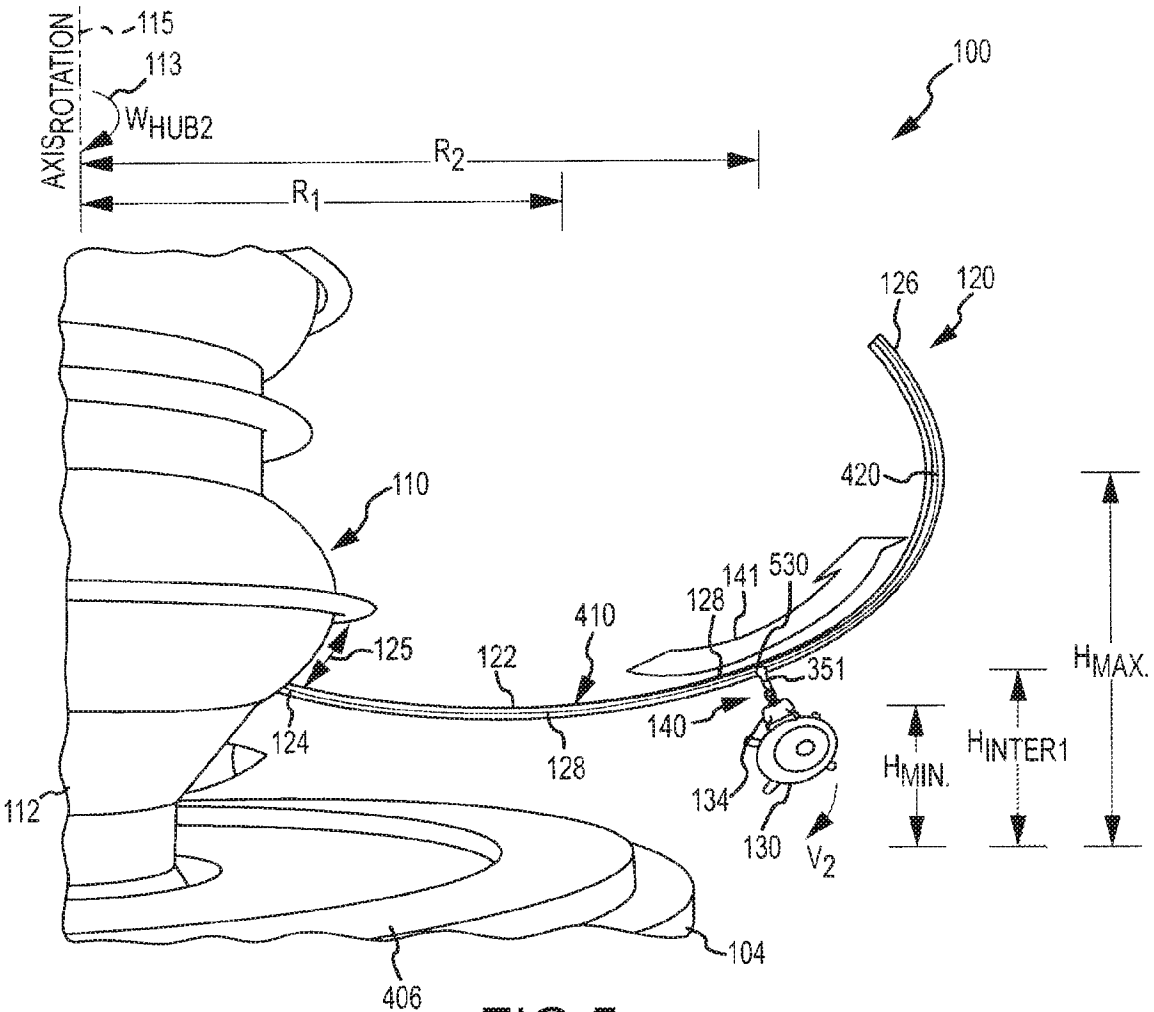
Figure 6:
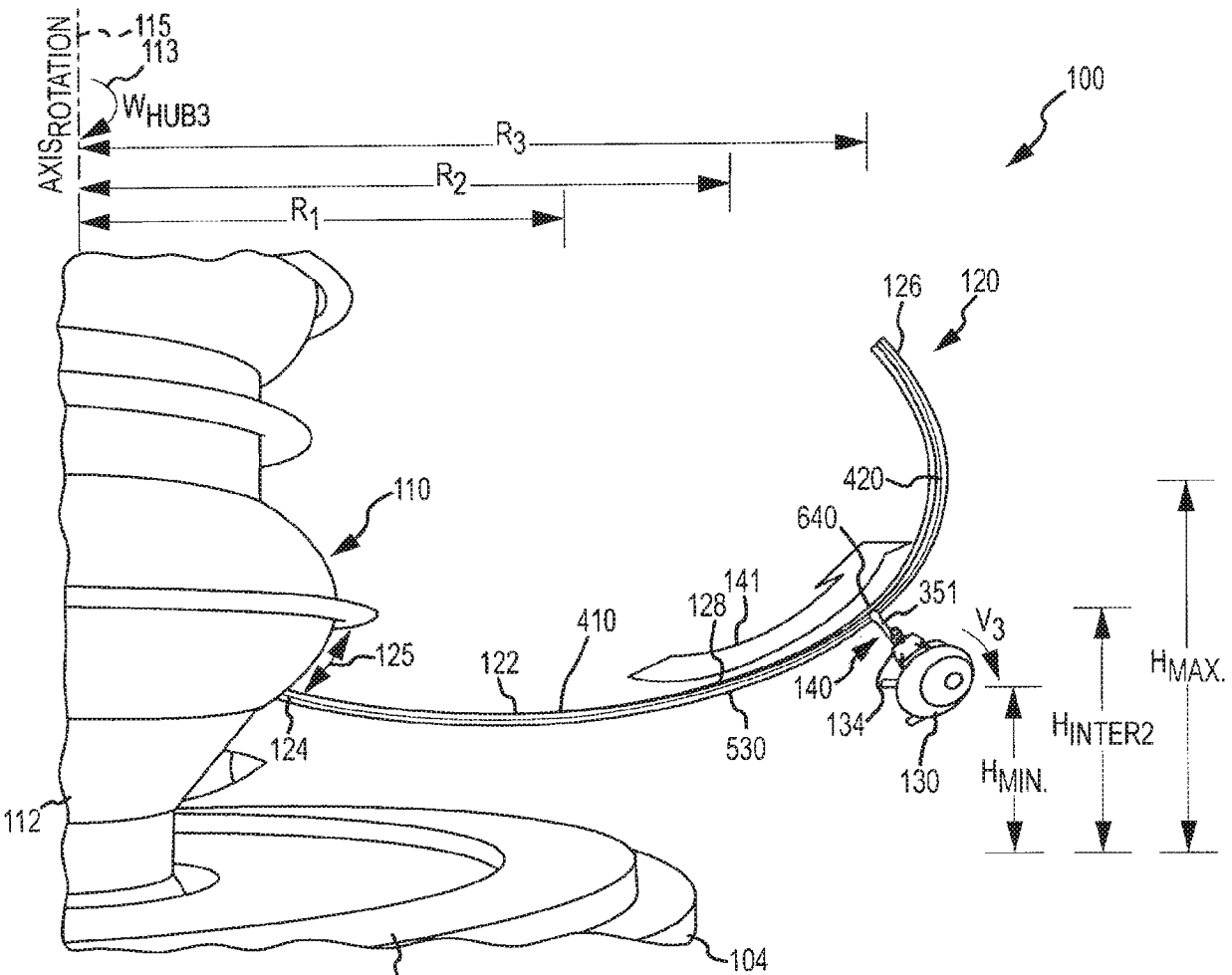

At this point, it may be useful to discuss operation of the ride 100 at three operating states or hub rotation speeds/rates to explain in more detail the tracks and how the rolling/sliding mounting of the vehicles on such tracks provides new ride experiences. FIGS. 4-6 illustrate a single arm or track 120 of the ride during operations that involve rotating the hub 112 at three different speeds about the axis of rotation 113. FIG. 4 illustrates the ride 100 with the hub stationary or at a very low rotation rate. For example, the ride 100 in FIG. 4 is shown during load/unload operations with the drive device of assembly 110 not rotating the hub (i.e., $\omega_{Hub1}$ is zero or nearly zero). When the hub 112 stops rotating, the vehicle 130 slides 141 radially inward along the track body 122 to load/unload position 410 proximate to the hub 112 (and corresponding to a minimal slope point of the track) and over or near loading/unloading platform 406 of foundation 104. The vehicle velocity, $V_1$, at this stage is also zero (or minimal in rides that can be loaded with vehicles moving slowly).

The vehicle 130 may slide 141 inward and down from a maximum radius/maximum travel position 420 to the load or unload position 410. At position 410, the vehicle 130 is also positioned at the minimum radius, $R_1$, of the ride 100, which may correspond with a "valley" or low slope section of the track 120. This latter aspect is shown with the labeling of the heights of track positions 410, 420 as minimum height, $H_{Min}$, and maximum height, $H_{Max}$, at which the vehicle 130 will travel during rotation 115 of hub 112. Due to the upward curved configuration of the track 120, the increasing height also corresponds to increasing slope of the track such that a higher point in the track 120 also means a greater track slope or that the track is angled upward to a greater degree. In other words, the minimum or load/unload radius, $R_1$, coincides with a section of track 120 having a minimum slope and, in this case, a minimum height, $H_{Min}$, for the track 120 traveled by the vehicle 130. Track position 420 coincides with a section of the track 120 having a maximum slope (or maximum slope at which the centrifugal and gravitational forces are balanced) and, in this case, a maximum height, $H_{Max}$, for the track 120 that may be traveled by the vehicle 130 (e.g., a maximum attainable equilibrium point). In other words, the vehicle 130 will slide (with the mounting assembly 140 having its support arm 351 attached to a bogie in body 122 that is accessed via slot 128 in the front sidewall of the track body 122) to the position 420 when the rotation 115 of the hub 112 is at a maximum value for the ride 100.

FIG. 5 illustrates the ride 100 at a second operating state. In this ride state, the assembly 110 (or its drive mechanism) is operated to rotate the hub 112 at a second rotation rate, $\omega_{Hub2}$, that is greater than the first rate (e.g., may be 4 to 8 RPM or the like). The rotation 115 of the hub 112 about the axis of rotation 113 causes the track 120 to rotate, too, and a radially outward force (greater centrifugal force) to be applied to the vehicle 130 that is only balanced by gravity when the vehicle 130 moves outward to a section of the track 120 with a greater slope/track angle. Since the mounting assembly 140 is configured for free (or braked) rolling in track 120, the vehicle 130 slides 141 radially outward from the axis 113 on the travel path defined by the track body 122 to a track position 530 that is intermediate between the load/unload position 410 and the maximum travel (end of travel) position 420 on the track body 122. As a result, in this embodiment, the vehicle's mounting height, $H_{Intermediate1}$, increases as does its mounting or vehicle radius, $R_2$, relative to the axis of rotation 113. The vehicle velocity, $V_2$, is defined by the rotation rate, $\omega_{Hub2}$, and also by the vehicle radius, $R_2$.

FIG. 6 illustrates the ride 100 at a third operating state. In this ride state, the assembly 110 is operating to rotate 115 the hub 112 at a third rotation rate, $\omega_{Hub3}$, that is at least somewhat greater than the second rotation rate, $\omega_{Hub2}$ (e.g., 8 to 10 RPM if the second rotation rate, $\omega_{Hub2}$, is in the range of 4 to 8 RPM or the like). Hence, greater centrifugal forces are applied on the vehicle to push it radial outward to a section of the track 120 with a greater track angle or slope. In the illustrated embodiment, the vehicle 130 is also moved to a second intermediate vehicle height, $H_{Intermediate2}$, (i.e., $H_{Intermediate2}$ is greater than $H_{Intermediate1}$) as well as to a larger radial position, $R_3$ (i.e., $R_3$ is greater than $R_2$). The track body 122 between travel path end positions 410, 420 is shown to be generally curved upward with end 420 at a height, $H_{Max}$, that is greater than a height, $H_{Min}$, of end 410, and, as a result, when rotation of the hub 112 is slowed or halted the vehicle 130 will slide under gravity back to the inner or load/unload position 410 over load/unload platform 406 without power/actuation.

Further, the curve or profile of the track body 122 between positions 410, 420 is not constant (e.g., the increasing slope with outward travel is not constant) with the track body 122 near inner/minimum radius position 410 being nearly linear (or a very large radius of curvature and very small slope that allows small rotation rates to generate centrifugal forces that push the vehicle outward) and the track body 122 near outer/maximum radius position 420 being sharply curved (or a relatively small radius of curvature with very quickly increasing slopes that require larger rotation rates to create centrifugal forces to balance gravity to achieve more distal (and higher, in this case) equilibrium points). Hence, a relatively small amount of centrifugal force is required to move the vehicle 130 outward from position 410 but the more rapid elevation gain near outer position 420 requires much more force to urge the vehicle 130 away from the hub 112 to greater vehicle radii. Of course, this is only one track profile or geometry, and numerous others may be used to practice the ride 100 (e.g., linear sections each with greater slopes/track angles, curved sections positioned side-by-side that each have relatively small slope increases compared to those shown in track 120, intermingling of small slope sections with large slope sections to vary outward sliding rates, and so on).

During operation of the ride 100, ongoing variation or changing of the hub rotation rate may be used. In other words, only three rotation rates are shown in FIGS. 4-6 but many more may be provided in a ride 100 and may be changed on a regular or irregular manner to vary the ride experience for the passengers 134. The track geometry may include a transition element in the track such as a twist between positions 410, 420, and the vehicle 130 may be moved repeatedly over this transition to cause more rapid changes in vehicle velocity or other vehicular dynamics.

Figure 7:
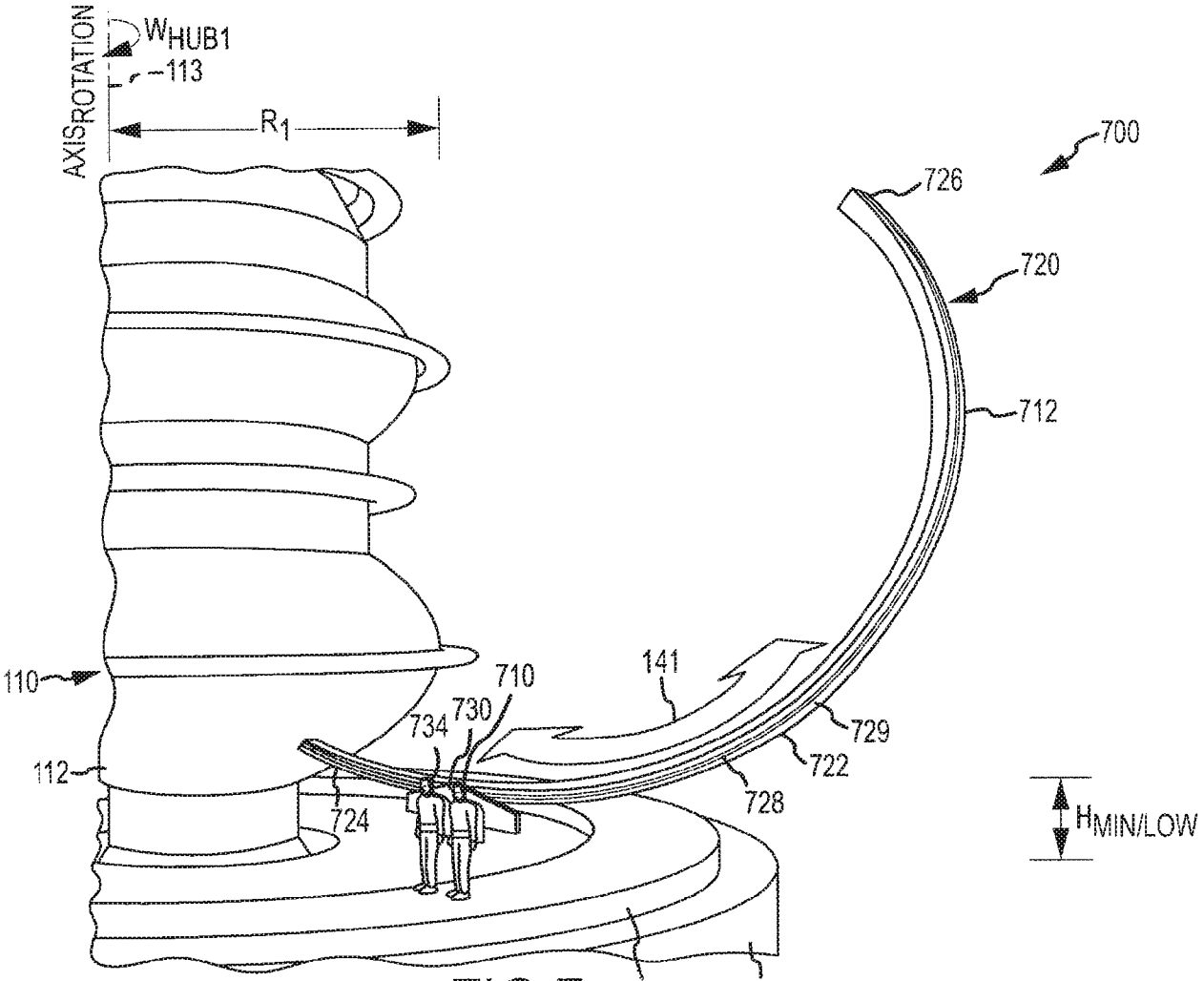
FIGS. 7 and 8 illustrate partial views of an embodiment of a slide ride similar to those shown in FIGS. 4-6 but utilizing another embodiment of a track that has a twist from the load point to the maximum outer travel point to place the supported vehicle in two or more orientations relative to the track as the vehicle slides radially inward and outward on the track with changing hub rotation rates (e.g., a 90-degree twist along the defined travel path for the vehicle to cause the vehicle to rotate 90 degrees such as from a vertical load position to a horizontal position at the largest orbiting or travel radius, which coincides with the maximum vehicle velocity for the ride)
Figure 8:
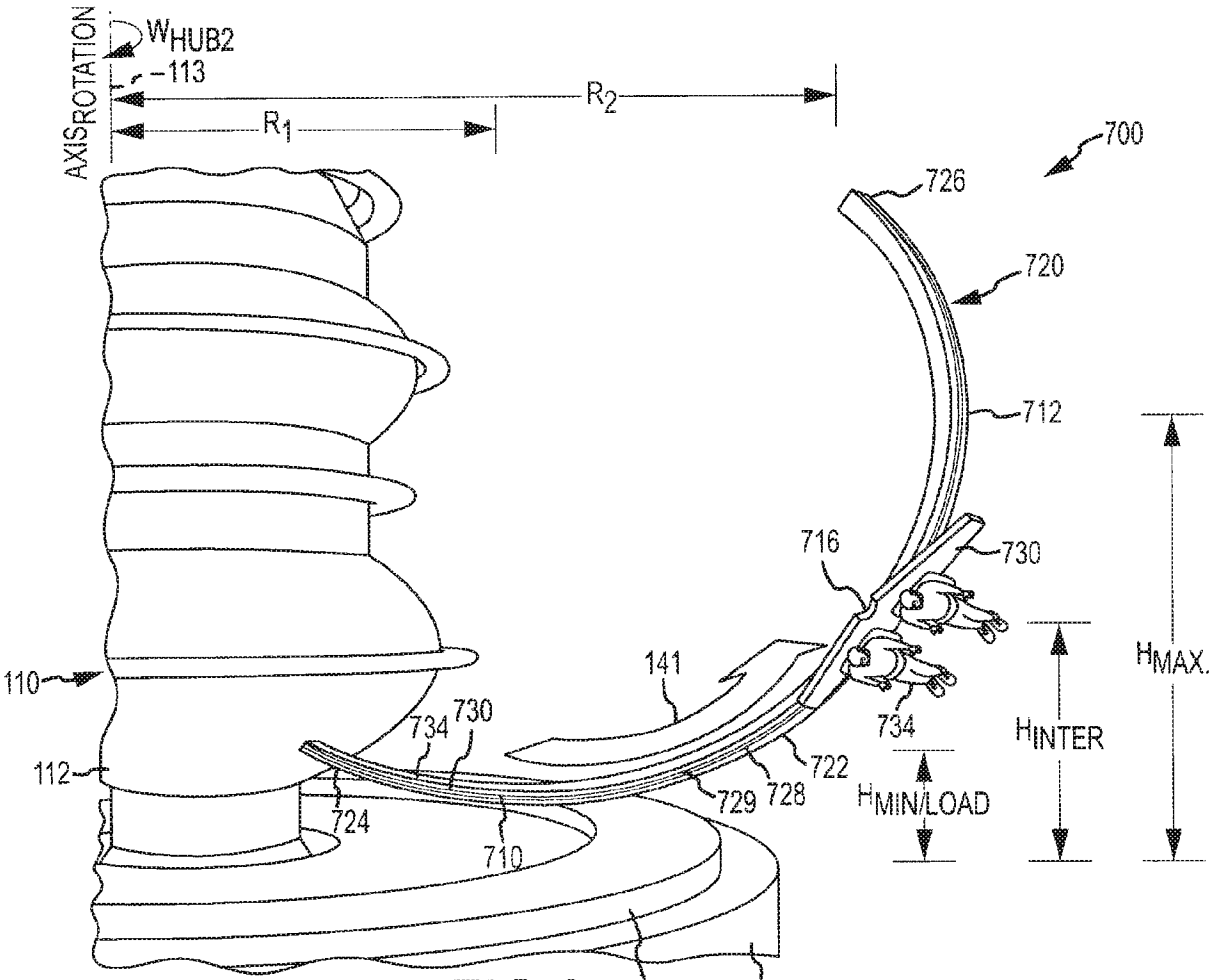

In some cases, it may be useful to provide an axial twist between two track positions such that the vehicle is rotated between two angular orientations relative to the longitudinal axis of the track. For example, FIGS. 7 and 8 illustrate a ride 700 in a load/unload or first operating state and at a representative later flying or second operating state. The ride is similar to that shown in FIGS. 4-6 with a rotating hub 112 about rotation axis 113 except that a different vehicle 730 and track 720 are used to provide a unique ride experience. The ride 700 is adapted to simulate jetpack flying and as such the vehicle 730 is a winged jet back structure that is mounted to the track 720 for sliding along the track (e.g., with a mounting assembly accessing a channel in track 720 via slot or groove 728).

The track 720 has a body 722 with a first end 724 coupled (fixed or pivotally) to the hub 112 and that extends outward to a second end 726 in a generally upward sloping (or increasing-slope sections) or curved manner. The body 722 may be elongated with a longitudinal axis extending along the body 722 at least from minimum vehicle radius position 710 (load/unload position) to maximum vehicle radius position 712 (largest slope (steepest section of track) that may be the highest vehicle travel point during operation of ride 700). The vehicle 730 is configured for vertical loading of two passengers 734 on a loading platform 406 of base 104.

To support such loading and also to simulate flight in a more prone flying position, the track body 722 between the track positions 710, 712 includes an axial twist (i.e., the body 722 is twisted about its longitudinal axis). The body 722 may be thought of as a rectangle (or even a ribbon) with four faces or sides, and the axial twist may call for the first end near position 710 and the second end near position 712 to be held and then to twist one end (such as the end near position 712) a predetermined amount. The axial twist may be, for example, selected from the range of 30 to 360 degrees to achieve a desired amount of rotation of the vehicle 730 about the axis of the track body 722.

For example, the face or side having the slot 728 may be positioned to face forward (e.g., a plane containing the side 729 near position 710 may be orthogonal, or nearly so, to loading platform 406). In this way, the track body 722 proximate to the loading/unloading position 730 (which has the minimum slope and, in this embodiment, track height, $H_{Min/}$ $_{Load}$ and also represents the minimum vehicle radius, $R_1$) supports the vehicle 730 in a vertical orientation to facilitate vertical loading/unloading of passengers 734. FIG. 7 illustrates the hub 112 when it is stationary or nearly so (e.g., $\omega_{Hub1}$ is zero or nearly so).

FIG. 8 shows the ride in a second operating state with the hub 112 rotated by assembly 110 at a second rotation rate, $\omega_{Hub2}$, which is rapid enough with the design of track 720 to force the vehicle 730 to slide 141 outward to an intermediate track position 716 (e.g., equilibrium point where with the track's slope in this section of track the centrifugal force is balanced by gravitational forces). This position 716 corresponds to a second or intermediate vehicle radius, $R_2$, and also with an intermediate height, $H_{Intermediate}$, that is greater than the load position height, $H_{min/load}$, but less than a maximum vehicle travel position 712 height, $H_{Max}$ (which is only achieved with the hub 112 is rotated at a predefined maximum ride speed to push the vehicle 730 outward into this more steeply sloped track section).

The track body 722 is twisted or has an axial twist approaching 90 degrees between positions 710 and 712 such that at position 716 near to outer limit position 712 the vehicle is rotated nearly 90 degrees (such as in the range of 65 to 80 degrees). This places the passengers 734 in a prone flying position without requiring actuators, complex linkages, or even a powered vehicle. The twist in body 722 may be described as an angular twisting relative to the longitudinal axis along the length of the body 722 between points 710 and 712 such that the face or side 729 with slot 728 is repositioned from being in a plane orthogonal to the ground/load platform plane to being in a plane that is parallel to the ground/load platform plane (or within 25 degrees or less of being parallel to such a plane) as shown in FIG. 8. Other axial twists may be applied to the track 720 to achieve vehicle rotation, and the twisting may occur in one portion of the track, be reversed in another, occur again, and so on between the innermost and outermost travel points 710, 712.

Figure 9:
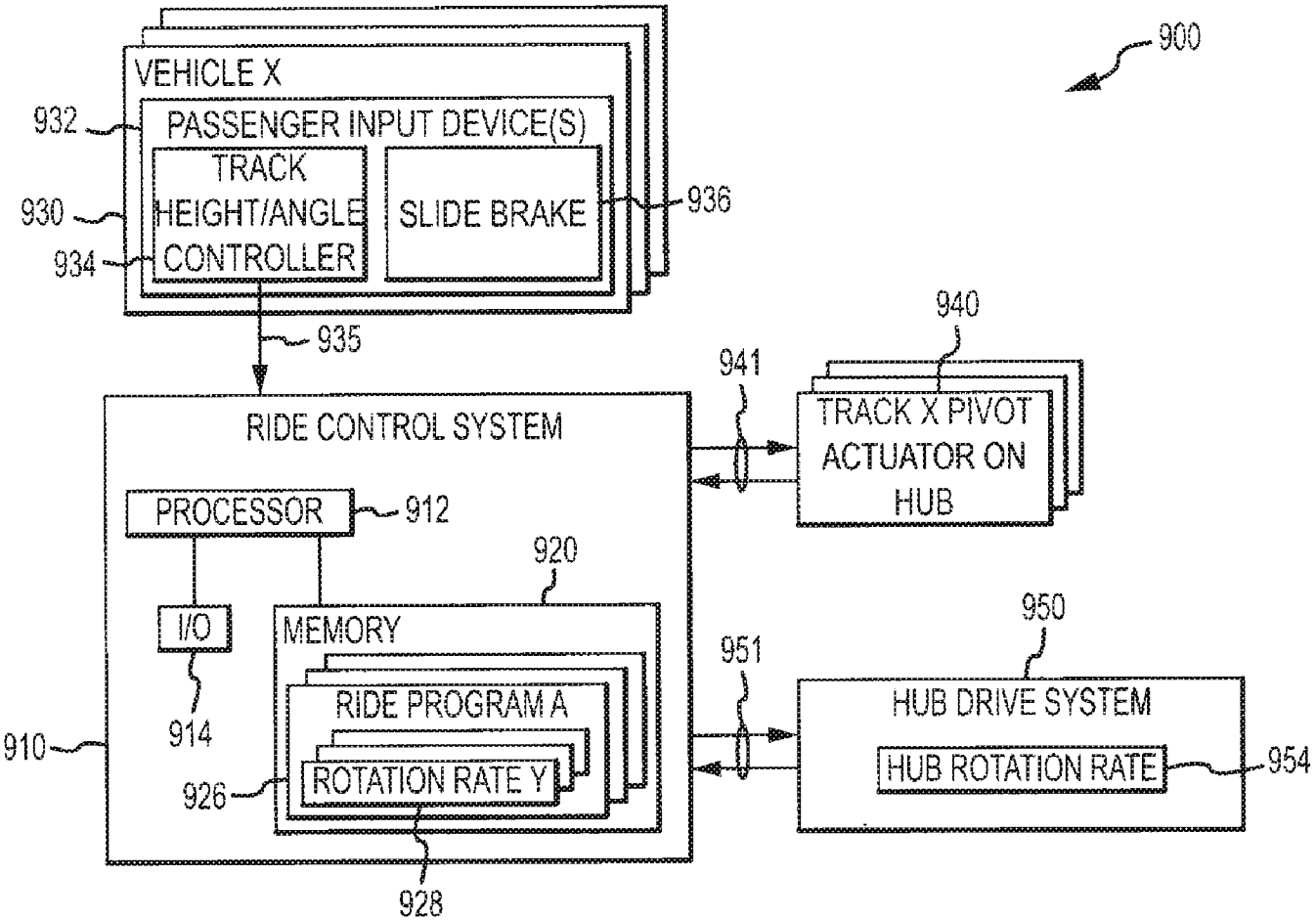
FIG. 9 illustrates with a functional block diagram a gravity slide ride system showing interaction of a ride control system with system components to control a ride experience including vehicle radial distance from an axis of rotation of a central rotating structure or hub.

FIG. 9 illustrates a gravity slide ride 900 in functional block form to facilitate description of how a ride and its components may be controlled and operated. The ride 900 is shown to include a ride control system 910, e.g., a computer or electronic device using a combination of hardware and software to perform ride control functions such as to implement the hub drive and arm positioning functions described above. The control system 910 may include a hardware processor(s) 912 that manages operation of input/output devices 914 and memory/data storage 920 (e.g., computer readable media, digital data storage devices, and the like). The I/O devices 914 may include keyboards, mice, touchscreens/touchpads, monitors, printers, and the like that allow an operator of the control system 910 to input data/commands and to view ride data such as operating status of the ride including angular orientations of arms/tracks and hub rotation rates. For example, an operator may initiate a ride program 926 that may define ride profiles that define hub rotation rates 928 and other ride parameters.

The ride program 916 typically is a software program/application (e.g., code devices) that cause the processor 912 or other portions of control system 910 to perform the functions described herein such as transmitting control signals 951 to operate a central drive system 950 to rotate the hub at two or more particular rotation rates 954 set by a ride program 926 as shown at 928 or as may be manually entered by an operator via I/O devices 914. The ride program 916 may also include a passenger input processor routine that processes passenger input 935 to then generate control signals 941 to operate an arm pivot actuator mechanism 940 (or such control may be more direct in some cases) to adjust the vertical angle of the track or support (e.g., adjust the elevation gain of the track).

Each vehicle 930 may include one or more passenger input devices 932 that allow passengers to interact with the ride 900. For example, a track height/angle controller 934 (e.g., a joystick, a touchscreen, a switch/lever, or the like) may be provided on the vehicle 930 to allow a passenger of the vehicle 930 to provide input 935 to the ride control system 910 (or directly to the pivot actuator 940). The ride control system 910 may act upon this input to control 941 the corresponding track pivot actuator 940 to move the arm/track up or down at its connection to the hub.

The input devices 932 may also include a slide brake or clutch 936 that may be operable by the passenger to stop or slow the lateral or radial movement of their vehicle 930 upon the track or arm. For example, the mounting assembly that allows the vehicle to slide or roll upon the track body may include a braking device that can be actuated by the passenger via brake/clutch 936 to either hold the vehicle 930 at its present radius even though hub rotation rates are changing or to slow such movement. The release of the brake 936 can then cause rapid movement inward or outward on the track, and holding a vehicle at a radius can achieve slower or faster vehicle velocities than otherwise would be expected/achieved at various hub rotation rates.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. The above discussion described the hub rotation rates as being at least two such that the vehicle slides or moves to at least two radii along the track body during hub rotation. Typically, though there are many rotation rates over a range of such rates as a particular rotation rate is not instantaneously achieved. For example, the maximum rotation rate may be 14 RPM for a particular hub and the minimum rotation rate may be 4 RPM (after unloading/loading which is 0 RPM). The hub may be rotated at any speed in between these two rates and the radial positions of the vehicle along the track are likewise numerous (nearly infinite) as the hub rotation rate may slowly move between a slower and faster rate (e.g., while speeding up to 8 RPM from 4 RPM, the rotation rates will be many as will the particular radius of the vehicle between an equilibrium point at 4 RPM and an equilibrium point at 8 RPM). Hence, a typical gravity slide ride will have a hub that rotates at many rotation rates and a vehicle that is positionable via sliding on a track extending radially outward from the hub in many radii corresponding to such hub rotation rates.

Passenger control may be added to a ride system in a variety of ways. For example, a passenger-controlled brake or clutch may be included on the passenger vehicle to provide the passengers a level of control over the vehicle motion, and this brake may stop or slow the sliding along the track such as to keep the vehicle at smaller vehicle radii nearer the hub (e.g., to keep their vehicle at a lower vehicle velocity for a particular hub rotation rate). The sliding brake/clutch could also provide greater velocity/acceleration and larger displacements/travel of the vehicle along the track than would be achievable without the brake.

In another example, the track may be connected to the hub through an actuated joint that may be controlled using input from the passenger (e.g., via an input device on the vehicle). Changing the vertical angle of the track changes the equilibrium point on the track for a given hub rotation speed by decreasing or increasing slopes of track sections, which allows the passenger to at least partially control the vehicle position along the track (and vehicle velocity by varying vehicle radius relative to the axis of rotation for the hub). A larger angle places the outer or second end of the track at a greater height relative to the inner or first end of the track, and the greater slopes (track angles) of the various track sections require greater hub rotation rates to position the vehicle at larger radii (thus, slowing the vehicle's rotation about the axis of rotation for a particular hub rotation rate).

As shown, the track and vehicle-to-track mounting assembly may be configured such that the track is above or below the vehicle. Further, in some ride embodiments, the vehicles are support by the mounting assembly such that the vehicles remain at constant yaw orientation/direction while in other cases the vehicles may spin on their connection to the track. Also, as shown, one especially interesting track configuration allows for easy loading and also a unique near-horizontal flying-type of ride experience. In this embodiment, the track is axially twisted between the minimum vehicle radius position and the maximum vehicle radius position such that the vehicle on each track rotates from a vertical load position to a horizontal flying position with increasing hub rotation rates, without requiring any additional actuation/vehicle-positioning equipment.

We claim:

1. A gravity slide ride supported on a foundation, comprising:

a drive assembly including a drive and a hub rotated, during operation of the drive, about a central axis of rotation at a first rotation rate and at a second rotation rate greater than the first rotation rate;

a track extending radially outward from an end coupled to the hub and defining a travel path with a first position in a first section of the track proximate to the hub and with a second position in a second section of the track distal from the hub, wherein the first section has a first slope and the second section has a second slope greater than the first slope;

a passenger vehicle; and a vehicle-to-track mounting assembly supporting the passenger vehicle on the track, wherein, during rotation of the hub, radially outward forces move the passenger vehicle to the first position on the track when the hub is rotated at the first rotation rate and to the second position on the track when the hub is rotated at the second rotation rate, and wherein the passenger vehicle includes an input device operable by a passenger of the passenger vehicle to limit a rate of movement of the passenger vehicle between the first and second positions, whereby the input device is operable to define a radial position of the passenger vehicle relative to the axis of rotation.

2. The ride of claim 1, wherein the mounting assembly rollably engages the track, whereby the passenger vehicle rolls on the track between the first and second positions as the drive increases or decreases the rotation rate of the hub between the first and second rotation rates.

3. The ride of claim 1, wherein the mounting assembly couples with the track to position the passenger vehicle between the track and the foundation.

4. The ride of claim 1, wherein the track has an elongate body with a longitudinal axis and wherein the body has an axial twist between the first and second positions, whereby the passenger vehicle is rotated relative to the foundation during movement along the travel path between the first and second positions.

5. The ride of claim 4, wherein the axial twist is at least about 45 degrees.

6. The ride of claim 1, wherein the travel path includes a third position in a third section of the track having a third slope less than the first slope and wherein, due to gravity, the passenger vehicle slides to the third position from the first or second positions when the hub is stationary.

7. The ride of claim 1, wherein the track has an arcuate profile between the first and second positions with at least two radii of curvature, whereby the track has a height that is increasing in magnitude between the first and second positions at two or more rates.

8. The ride of claim 1, wherein the vehicle is mounted on the body of the support arm with a mounting assembly comprising a bogie providing free-rolling engagement between the body and the mounting assembly, whereby the movement of the vehicle between the inner to the outer positions is responsive to radially outward forces created by the rotation of the hub.

9. A round ride with vertical loading and flying vehicle positions, comprising:

a central hub first operated in a stationary position, second operated to rotate about an axis of rotation at a first rotation rate, and third operated to rotate about the axis of rotation at a second rotation rate faster than the first rotation rate;

a track member supported on the central hub and extending outward from the axis of rotation of the central hub, the track member having a body with a longitudinal axis and having an axial twist between a first position and a second position more distal from the axis of rotation than the first position; and a vehicle adapted for supporting a passenger, wherein the vehicle is slidably mounted on the track body and wherein the vehicle slides laterally inward and outward on the track body in response to rotation of the central hub to be positioned proximate the first position when the central hub is stationary, at an intermediate position between the first and second positions when the central hub is rotated at the first rotation rate, and proximate the second position when the central hub is rotated at the second rotation rate, wherein the axial twist causes the vehicle to rotate from a first angular orientation relative to a plane extending through the axis of rotation when the vehicle is positioned proximate to the first position to a second angular orientation relative to the plane when the vehicle is positioned at the second position, and wherein the rotation of the vehicle to the second angular orientation is selected from the range of 30 to 90 degrees of rotation.

10. The ride of claim 9, wherein the first angular orientation places a vertical plane of the vehicle within 15 degrees of parallel with the plane extending through the axis of rotation, whereby the vehicle is rotated from a substantially vertical loading position associated with the first position on the track to a prone flying position associated with the second position on the track.

11. The ride of claim 9, wherein the body has a height at the second position that is greater than a height of the body at the first position.

12. The ride of claim 11, wherein the vehicle includes a mounting assembly with wheels supported on a wheel carrier and the wheels abutting surfaces of the track body and wherein the track body has a non-linear, curved geometry between the first and second positions of the track.

13. An amusement park ride, comprising:

a drive assembly including a hub rotatable about a central axis;

support arms coupled to the hub, the support arms having a body defining a travel path with an inner equilibrium position at a first height in a first section having a first slope and an outer equilibrium position at a second height, greater than the first height, in a second section having a second slope greater than the first slope; and on each of the support arms, a vehicle mounted to move between the inner position and the outer position in response to rotation of the hub by the drive assembly, wherein the vehicle is positioned vertically below the body for at least a portion of the body between the inner and outer positions, and wherein the body is an elongate member with a longitudinal axis and has an axial twist between the inner and outer positions, the vehicle is rotated between a load/unload position when proximate to the inner position and a differing ride position when proximate to the outer position.

14. The ride of claim 13, wherein the vehicle is mounted on the body of the support arm with a mounting assembly comprising a bogie providing free-rolling engagement between the body and the mounting assembly, whereby the movement of the vehicle between the inner to the outer positions is responsive to radially outward forces create by the rotation of the hub.

15. The ride of claim 14, wherein the drive assembly rotates the hub at a first rotation rate and at a second rotation rate greater than the first rotation rate and wherein, in response, the vehicle rolls on the body to the inner position when the hub is rotating at the first rotation rate and to the outer position when the hub is rotating at the second rotation rate.

16. The ride of claim 13, wherein the first and second sections of the support arm have a non-constant slope from an inner end to an outer end.

17. An amusement park ride, comprising:

a drive assembly including a hub rotatable about a central axis of rotation;

support arms coupled to the hub, the support arms having a body defining a travel path with an inner equilibrium position at a first height in a first section having a first slope and an outer equilibrium position at a second height, greater than the first height, in a second section having a second slope greater than the first slope;

on each of the support arms, a vehicle mounted to move between the inner position and the outer position in response to rotation of the hub by the drive assembly, wherein the ride is supported on a foundation, the drive assembly includes a drive, and the hub being rotated, during operation of the drive, about the central axis of rotation at a first rotation rate and at a second rotation rate greater than the first rotation rate; and wherein each of the support arms defines a track extending radially outward from an end coupled to the hub and defining a travel path with a first position in a first section of the track proximate to the hub and with a second position in a second section of the track distal from the hub, wherein the first section has a first slope and the second section has a second slope greater than the first slope;

and further comprising a vehicle-to-track mounting assembly supporting the passenger vehicle on the track, wherein, during rotation of the hub, radially outward forces move the passenger vehicle to the first position on the track when the hub is rotated at the first rotation rate and to the second position on the track when the hub is rotated at the second rotation rate, wherein the mounting assembly couples with the track to position the passenger vehicle between the track and the foundation.

18. The ride of claim 17, wherein the drive assembly rotates the hub at a first rotation rate and at a second rotation rate greater than the first rotation rate and wherein, in response, the vehicle rolls on the body to the inner position when the hub is rotating at the first rotation rate and to the outer position when the hub is rotating at the second rotation rate.

19. The ride of claim 17, wherein the vehicle is positioned vertically below the body for at least a portion of the body between the inner and outer positions, wherein the body is an elongate member with a longitudinal axis and has an axial twist between the inner and outer positions, and wherein the vehicle is rotated between a load/unload position when proximate to the inner position and a differing ride position when proximate to the outer position.

20. The ride of claim 17, wherein the first and second sections of the support arm have a non-constant slope from an inner end to an outer end.

21. The ride of claim 17, wherein the passenger vehicle includes an input device operable by a passenger of the passenger vehicle to limit a rate of movement of the passenger vehicle between the first and second positions, whereby the input device is operable to define a radial position of the passenger vehicle relative to the axis of rotations.

* * * * *